US009168745B2

(12) United States Patent
Chen et al.

(10) Patent No.: US 9,168,745 B2
(45) Date of Patent: Oct. 27, 2015

(54) INK JET PRINT HEAD ASSEMBLY HAVING AN ANGLED CARRIER BODY AND METHOD

(71) Applicant: Illinois Tool Works Inc., Glenview, IL (US)

(72) Inventors: Tzer-Yi Chen, Brookfield, CT (US); Luigi A. Cazzaniga, Bethel, CT (US); Mustafa R. Turan, Brookfield, CT (US)

(73) Assignee: Illinois Tool Works LLC, Glenview, IL (US)

( * ) Notice: Subject to any disclaimer, the term of this patent is extended or adjusted under 35 U.S.C. 154(b) by 0 days.

(21) Appl. No.: 14/490,136

(22) Filed: Sep. 18, 2014

(65) Prior Publication Data

US 2015/0103118 A1 Apr. 16, 2015

Related U.S. Application Data

(60) Provisional application No. 61/891,011, filed on Oct. 15, 2013.

(51) Int. Cl.
*B41J 2/045* (2006.01)
*B41J 2/14* (2006.01)

(52) U.S. Cl.
CPC ..... *B41J 2/14233* (2013.01); *B41J 2/14016* (2013.01); *B41J 2/14274* (2013.01); *B41J 2202/11* (2013.01)

(58) Field of Classification Search
None
See application file for complete search history.

(56) References Cited

U.S. PATENT DOCUMENTS

2012/0182356 A1* 7/2012 Hayashi et al. ..... 347/68

OTHER PUBLICATIONS

ISR and Written Opinion for PCT/US2014/058371 dated Dec. 11, 2014 (28 pgs.).

* cited by examiner

*Primary Examiner* — Geoffrey Mruk
*Assistant Examiner* — Bradley Thies
(74) *Attorney, Agent, or Firm* — The Small Patent Law Group LLC; Christopher R. Carroll

(57) ABSTRACT

An ink jet print head assembly includes a carrier body, plural pistons, and a printing plate. The pistons are configured to actuate in ejection directions in order to engage a diaphragm plate of the printing plate and cause fluid to be ejected from orifices of the printing plate along printing directions. The ejection directions in which the pistons are actuated are transversely oriented with respect to printing directions in which the fluid is ejected from the printing plate.

23 Claims, 7 Drawing Sheets

INK JET PRINT HEAD ASSEMBLY HAVING AN ANGLED CARRIER BODY AND METHOD

CROSS-REFERENCE TO RELATED APPLICATIONS

This application claims priority to U.S. Provisional Application No. 61/891,011, which was filed on 15 Oct. 2013, and the entire disclosure of which is incorporated herein by reference.

BACKGROUND

Embodiments of the inventive subject matter described herein relate to ink jet printing.

BRIEF DESCRIPTION

In one embodiment, an ink jet print head assembly includes a carrier body, plural pistons, and a printing plate. The carrier body has an ejection side configured to face an object to be printed upon. The pistons are coupled with the carrier body. The printing plate is coupled with the ejection side of the carrier body and includes a diaphragm plate. The printing plate is configured to hold a fluid to be printed on the object on a side of the diaphragm plate that is opposite of the pistons. The printing plate includes orifices through which the fluid is ejected from the printing plate and onto the object being printed upon. The pistons are configured to actuate in ejection directions in order to engage the diaphragm plate and cause the fluid to be ejected from the orifices of the printing plate along printing directions. The ejection directions in which the pistons are actuated are transversely oriented with respect to the printing directions in which the fluid is ejected from the printing plate.

In one embodiment, an ink jet print head assembly includes a carrier body and plural pistons. The carrier body has an ejection side configured to face an object to be printed upon. The pistons are coupled with the carrier body. The pistons are configured to actuate in ejection directions in order to engage a diaphragm plate in a printing plate connected with the ejection side of the carrier body and cause fluid in the printing plate to be ejected from the orifices of the printing plate along printing directions. The ejection directions in which the pistons are actuated are transversely oriented with respect to the printing directions in which the fluid is ejected from the printing plate.

In one embodiment, an ink jet print head assembly includes a printing plate, a carrier body, and plural pistons. The printing plate includes a printing end configured to face an object to be printed upon by a fluid. The printing plate also includes separate chambers in which the fluid is disposed prior to printing on the object and orifices through which the fluid is ejected from the printing plate and onto the object. The carrier body is configured to be coupled with the printing plate. The pistons are configured to be coupled with the carrier body and to be actuated to strike the chambers in the printing plate and cause the fluid in the chambers to be expelled from the printing plate via the orifices. The pistons are configured to be strike the chambers when the pistons are actuated along ejection directions that are oriented at non-parallel and non-perpendicular angles with respect to the printing end of the printing plate.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein provide ink jet print head assemblies and associated methods. The print head assemblies can be used to print at relatively rapid speeds and at increased resolutions relative to other known print head assemblies.

Figure 1:
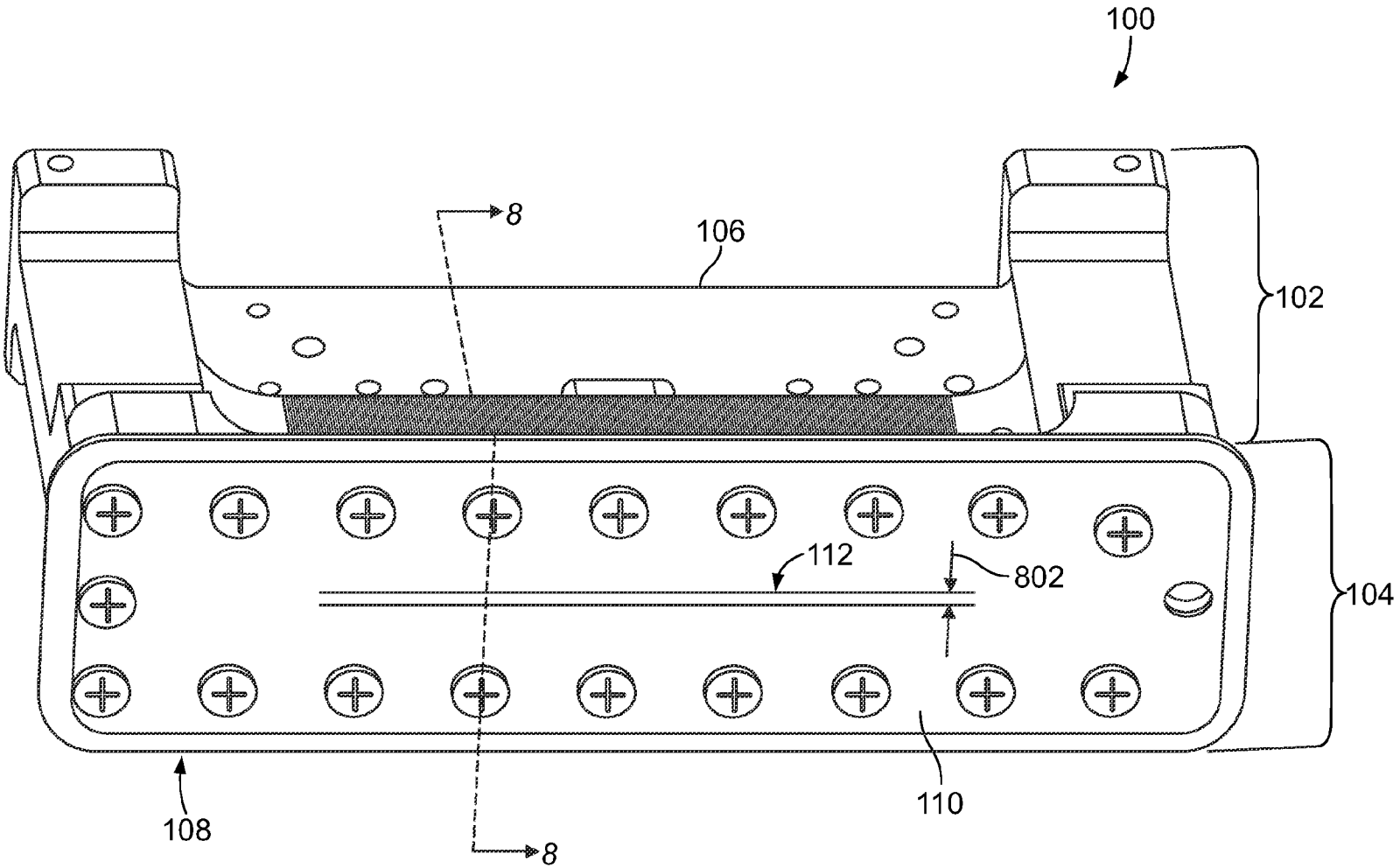
FIG. 1 is a perspective view of an ink jet print head assembly from a front or printing side in accordance with one embodiment.

FIG. 1 is a perspective view of an ink jet print head assembly 100 from a front or printing side in accordance with one embodiment. The assembly 100 can be used to print ink onto objects (such as packages, boxes, labels, and the like), goods (such as lumber, dry wall, and the like), or other items. As one example, the assembly 100 can print bar codes, labels, or other identifying indicia on objects. Additionally or alternatively, the assembly 100 can print chemicals used in the manufacture of various equipment (e.g., display devices, solar cells, ultraviolet thin films, coatings, or the like), such as by printing polyimides onto glass during the manufacture of display devices (e.g., Liquid Crystal Display screens). The assembly 100 includes a mechanical actuation segment 102 coupled with a fluidic segment 104. The mechanical actuation segment 102 includes various components that move in order to cause a fluid (e.g., an ink or other flowable matter) to be ejected from the assembly 100 and printed onto an object. The fluidic segment 104 includes various components that direct the internal flow of the fluid in the assembly 100 so that the movement occurring in the mechanical actuation segment 102 causes the fluid to be ejected from the assembly 100.

The mechanical actuation segment 102 includes a carrier body 106 that supports various components of the assembly 100. The carrier body 106 is connected with a front printing end 108 of the fluidic segment 104. The front printing end 108 includes a printing plate 110, such as a Chamber Plate/Orifice Plate (CPOP), which controls the flow of the fluid inside the assembly 100 and from which the fluid is ejected from the assembly 100. Several ejection orifices 112 extend into the plate 110. The fluid is ejected from the assembly 100 out of these orifices 112.

Figure 2:
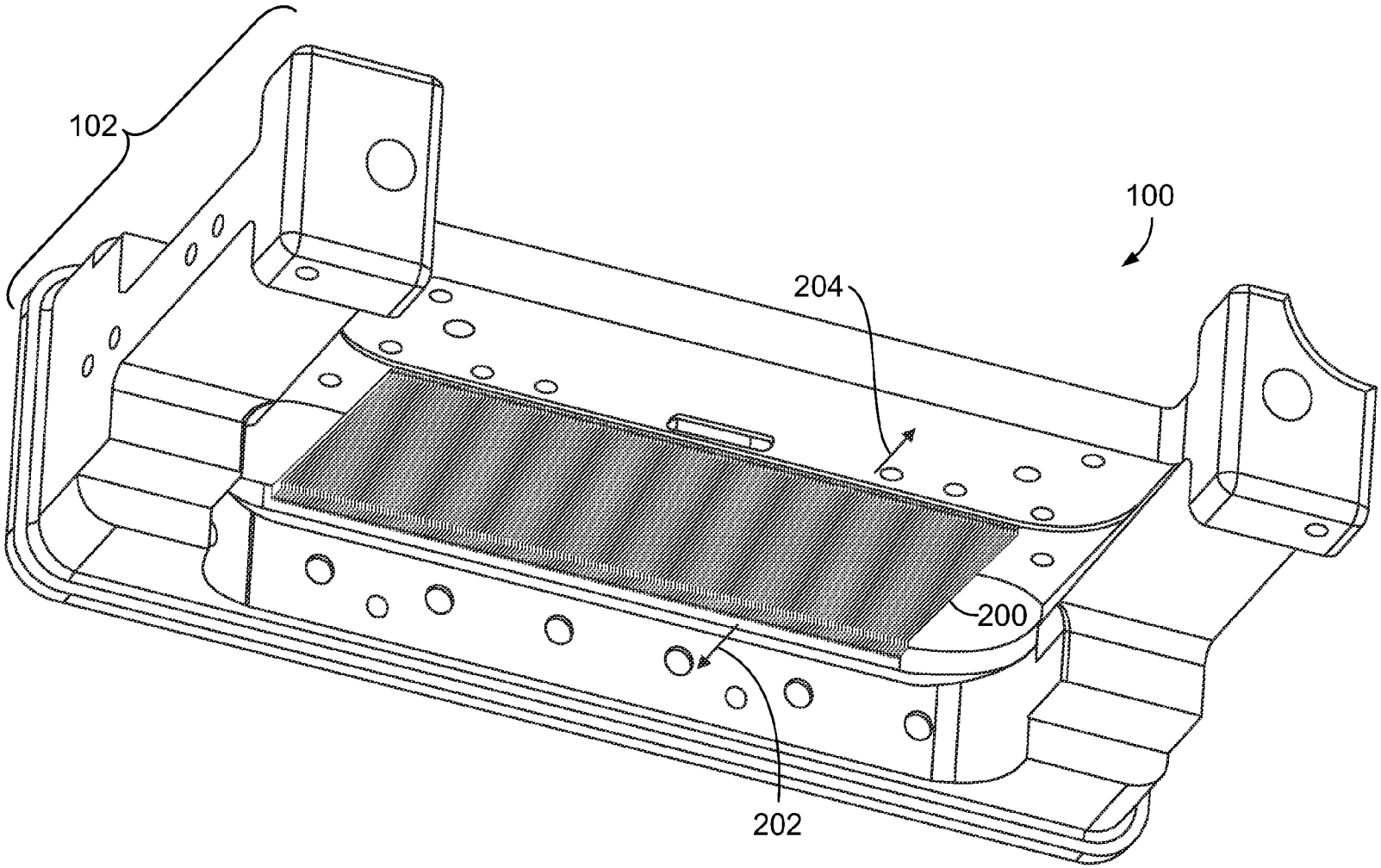
FIG. 2 is another perspective view of the assembly of FIG. 1 shown from a back end or rear side of the assembly.

FIG. 2 is another perspective view of the assembly 100 of FIG. 1 shown from a back end or rear side of the assembly 100. The mechanical actuation segment 102 includes several pistons 200 that move to cause fluid to be ejected out of the orifices 112 in the plate 110 (shown in FIG. 1). The pistons 200 are actuated to move in opposite directions including an ejection direction 202 and a retreating direction 204. Different pistons 200 are linearly aligned with different orifices 112 in the plate 110. For example, the ejection and retreating directions 202, 204 in which each piston 200 moves may be linearly aligned with an orifice 112. Movement of a piston 200 in the ejection direction 202 of that piston 200 causes fluid to be ejected from the orifice 112 that is aligned with the ejection direction 202 of the piston 200. Movement of the piston 200 in the retreating direction 204 may not cause fluid to be ejected from the corresponding orifice 112. The orifices 112 may be linearly aligned with the pistons 200 in that the ejection and retreating directions 202, 204 of the pistons 200 may be collinear with the orifices 112 of the pistons 200 such that the directions 202, 204 may extend through the orifices 112 of the respective pistons 200.

The pistons 200 may be individually controlled such that each piston 200 may separately move in the ejection direction 202 or the retreating direction 204 while one or more, or all, other pistons 200 move in the same or other direction 202 or 204, regardless of the direction in which each piston 200 is actuated to move. Alternatively, groups of two or more pistons 200 may be controlled to move in the same direction 202 or 204 at the same time. Control of which pistons 200 are moving in the ejection direction 202 and which pistons 200 are moving in the retreating direction 204 at a given time allows for control of where fluid is ejected from the assembly 100 and allows for the printing of various images, text, and the like.

In one embodiment, the pistons 200 include or are formed from piezoelectric (PZT) materials. The pistons 200 can be actuated to move in the ejection directions 202 by applying electric energy (e.g., a direct current voltage signal or electric field) to the pistons 200 and may be actuated to move in the retreating directions 204 by removing or changing this electric energy. Conversely, the pistons 200 may move in the retreating direction 204 by applying the electric energy and in the ejection direction 202 by removing the electric energy. The movement along the ejection direction 202 of the pistons 200 may result from the pistons 200 becoming larger (e.g., longer along the direction in which the pistons 200 are elongated) when the electric energy (e.g., voltage) is applied in a direction along the length of the pistons 200. For example, the pistons 200 may move in the ejection direction 202 by changing shape along the ejection direction 202 (e.g., become longer) without the pistons 200 being displaced along the ejection direction 202. The pistons 200 may move in the retreating direction 204 by changing shape along the retreating direction 204, such as by the pistons 200 becoming shorter, without the pistons 200 being displaced in the retreating direction 204.

The electric energy used to actuate the pistons 200 can be supplied by a power source (not shown) and a controller (not shown) of the assembly 100, such as by a voltage source controlled by hardware circuitry that includes and/or is coupled with one or more processors, microcontrollers, or other logic-based devices that control when the electric energy is supplied to each of the pistons 200. Optionally, the pistons 200 may be actuated in another manner. For example, the pistons 200 may be displaced in the ejection and retreating directions 202, 204 by one or more mechanical actuators.

Figure 3:
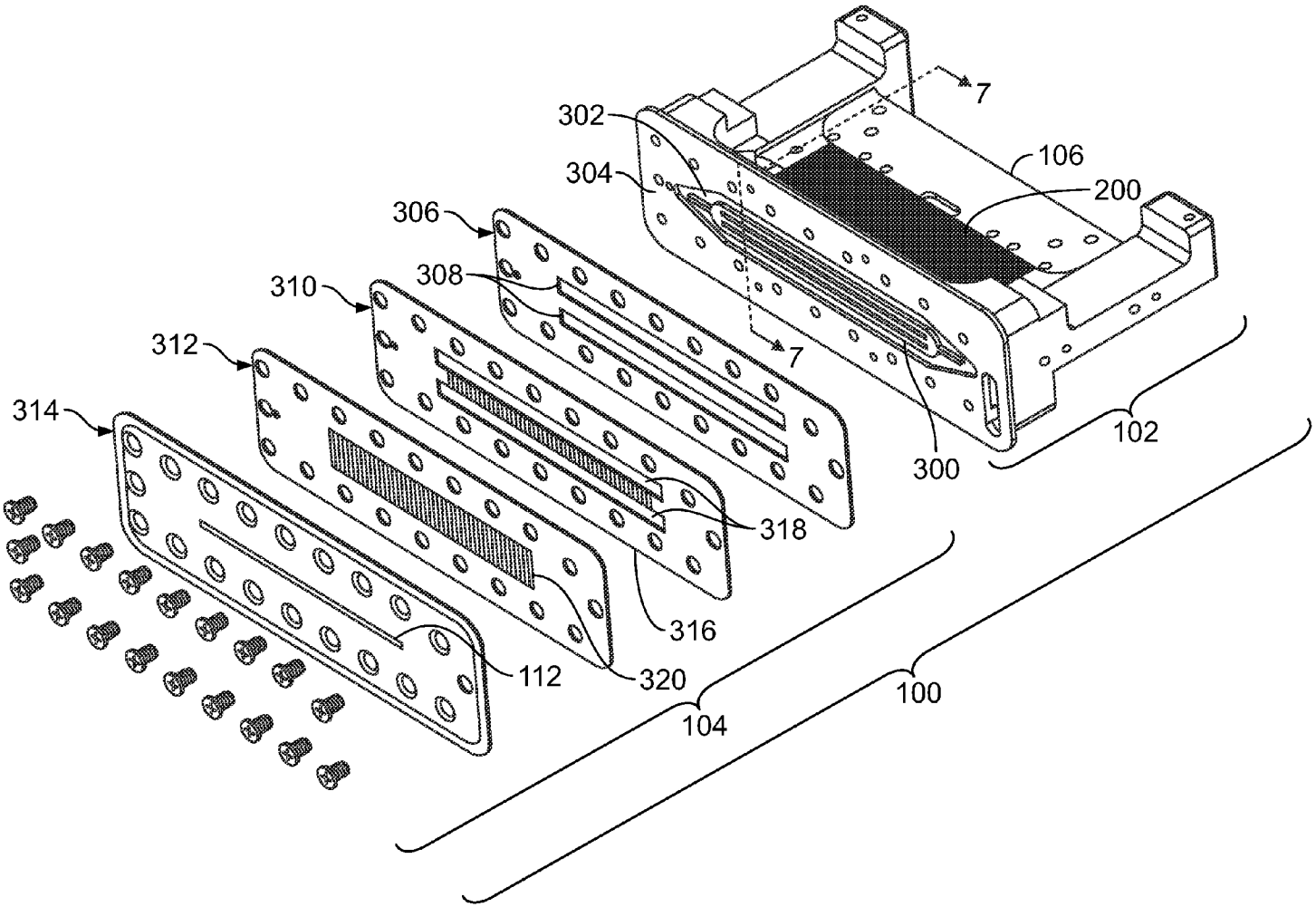
FIG. 3 is an exploded view of the assembly shown in FIG. 1.

FIG. 3 is an exploded view of the assembly 100 shown in FIG. 1. The carrier body 106 includes an ejection side 304 that faces the same direction in which fluid is ejected from the assembly 100. Several openings 300 extend through the ejection side 304 of the carrier body 106. These openings 300 are aligned with the different pistons 200. These openings 300 may be disposed along the respective ejection directions 202 (shown in FIG. 2) of the pistons 200 so that movement of the pistons 200 along the ejection directions 202 cause the pistons 200 to travel toward and/or enter into the openings 300 in order to eject fluid from the assembly 100. The carrier body 106 includes a channel or manifold 302 that is recessed into the ejection side 304 of the carrier body 106. The channel or manifold 302 provides a space that holds the fluid to be ejected from the assembly 100. In the illustrated embodiment, the channel or manifold 302 extends around or encircles the openings 300 so that the fluid extends around the openings 300 prior to being ejected from the assembly 100.

The fluidic segment 104 includes the CPOP 110, which is formed from several plates 306, 310, 312, 314 coupled together. A diaphragm plate 306 is coupled with the ejection side 304 of the carrier body 106. The diaphragm plate 306 separates the ends of the pistons 200 from chambers that hold the fluid, as described below. The diaphragm plate 306 is struck by the pistons 200 when the pistons 200 move in the ejection directions 202. The striking of the diaphragm plate 306 by one or more of the pistons 200 causes the chambers aligned with these pistons 200 on the opposite side of the diaphragm plate 306 to be compressed. This compression causes the fluid in the chambers to exit the chambers and be printed onto an object via the orifices 112 (shown in FIG. 1). The diaphragm plate 306 includes fluid passageways 308 that permit the fluid in the manifold or channel 302 to pass through the diaphragm plate 306. The diaphragm plate 306 separates the pistons 200 from the fluid such that the fluid does not contact the pistons 200. For example, the pistons 200 may engage the diaphragm plate 306 at or near the area of the diaphragm plate 306 that is disposed between the passageways 308.

A spacer plate 310 is coupled with the diaphragm plate 306 so that the diaphragm plate 306 is between the spacer plate 310 and the carrier body 106. The spacer plate 310 includes several chambers 316 that are linearly aligned with the ejection directions 202 of the pistons 200. For example, the chambers 316 may be positioned along the ejection directions 202 such that the pistons 200 move toward the chambers 316 when the pistons 200 move in the ejection directions 202. The chambers 316 define bounded volumes inside the fluidic segment 104 of the assembly 100 where the fluid flows into prior to being ejected from the assembly 100 via the orifices 112. For example, the chambers 316 in the spacer plate 310 may be openings that, when the spacer plate 310 is coupled with the diaphragm plate 306 and a restrictor plate 312 (described below), the openings in the spacer plate 310 are at least partially enclosed to define the chambers 316. Each piston 200 may be associated with a chamber 316 that is compressed by the piston 200 to eject fluid from a respective orifice 112. Optionally, several pistons 200 may compress a single chamber 316 or several chambers 316 may be compressed by a single piston 200 to eject the fluid.

For example, the fluid may flow from the channel or manifold 302 of the carrier body 106, through the fluid passageways 308 of the diaphragm plate 306, and through fluid passageways 318 of the spacer plate 310. The fluid may then flow into the chambers 316. As described above, the striking of the diaphragm plate 306 by one or more of the pistons 200 causes the chambers 316 aligned with the pistons 200 on the opposite side of the diaphragm plate 306 to be compressed. This compression causes the fluid in the chambers 316 to exit the chambers 316 and be printed onto an object via the orifices 112. In one embodiment, the spacer plate 310 can include a filter (e.g., a mesh or other device) that removes solid particles from the fluid prior to the fluid being received in the chambers 316 and/or being ejected from the chambers 316 and the assembly 100.

A restrictor plate 312 is coupled with the spacer plate 310 so that the spacer plate 310 is between the restrictor plate 312 and the diaphragm plate 306. The restrictor plate 312 includes flow paths 320 that are fluidly coupled with the chambers 316 defined by the spacer plate 310. These flow paths 320 may direct the flow of fluid from the chambers 316 into the orifices 112 of the assembly 100. For example, the flow paths 320 may be openings through the restrictor plate 312 that are separate from each other but that are at least partially aligned with the chambers 316. When a chamber 316 is compressed by a piston 200, the fluid in the chamber 316 exits the chamber 316 through the flow path 320 that is aligned with the chamber 316. The fluid may be directed by the flow path 320 to one or more of the orifices 112 that are fluidly coupled with the flow path 320.

A chamber or orifice plate 314 is coupled with the restrictor plate 312 so that the restrictor plate 312 is between the spacer plate 310 and the chamber or orifice plate 314. The plate 314 includes the orifices 112 that are fluidly coupled with the chambers 316 by the flow paths 320. As described above, when a piston 200 strikes the diaphragm plate 306, one or more chambers 316 are compressed and the fluid in the compressed chambers 316 flows into the plate 314 via the flow paths 320 and out of the assembly 100 via the orifices 112.

Figure 4:
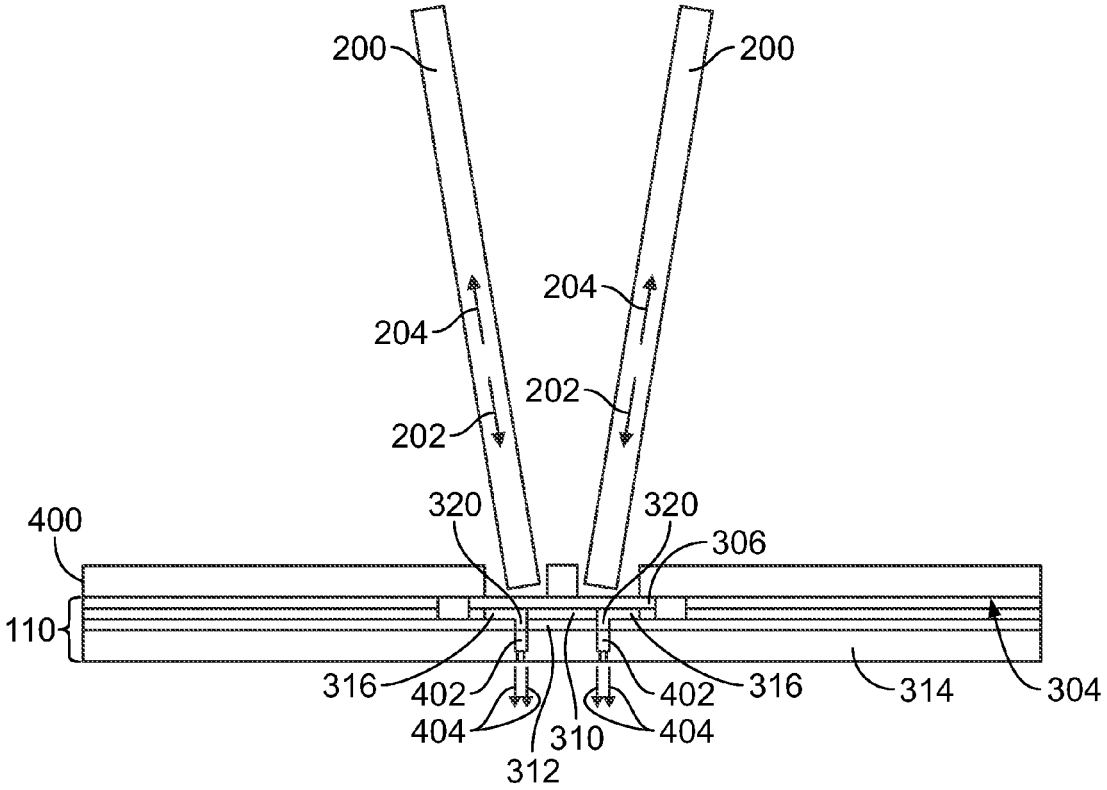
FIG. 4 is a schematic diagram of a pair of pistons shown in FIG. 2 and a printing plate shown in FIG. 1.

FIG. 4 is a schematic diagram of a pair of the pistons 200 shown in FIG. 2 and the printing plate 110. The diagram in FIG. 4 is not drawn to scale. Also shown in FIG. 4 is a portion 400 of the carrier body 106 that includes the ejection side 304. As described above, the pistons 200 can move in the ejection direction 202. This movement causes the pistons 200 to move toward and strike the diaphragm plate 306, such as in locations at or near the chambers 316 formed by the plates 306, 310, 312. When the chambers 316 are compressed, the fluid in the chambers 316 flows out of the chambers 316, through the respective flow paths 320, and into openings 402 extending through at least part of the thickness of the plate 314. The openings 402 are fluidly coupled with the orifices 112, through which the fluid is ejected from the assembly 100 along printing directions 404. Although two orifices 112 are shown as being fluidly coupled with each opening 402, optionally, a smaller or larger number of orifices 112 may be fluidly coupled with one or more of the openings 402. The pistons 200 may move away from the diaphragm plate 306 along the opposite retreating directions 204 to allow for additional fluid to flow into the chambers 316 for the next time the pistons 200 are actuated to move in the ejection directions 202.

As shown in FIG. 4, the ejection and retreating directions 202, 204 are transversely oriented with respect to the printing directions 404. For example, the pistons 200 may be actuated in directions that are not parallel or perpendicular to the direction in which the fluid is ejected from the assembly 100. Instead, the pistons 200 may move in directions that are oriented at acute angles with respect to the printing directions 404.

Figure 5:
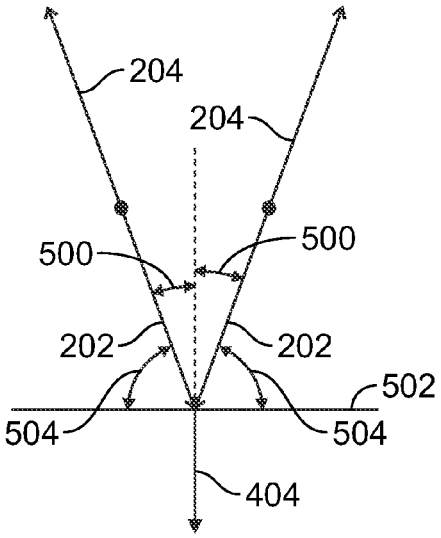
FIG. 5 illustrates a relationship between ejection, retreating, and printing directions shown in FIGS. 2 and 4.

FIG. 5 illustrates a relationship between the ejection, retreating, and printing directions 202, 204, 404. As shown in FIG. 5, the ejection and retreating directions 202, 204 may be oriented at an acute angle 500 with respect to the printing direction 404. This angle 500 may be relatively small, such as one to three degrees, or another angle, without the printing direction 404 being parallel or perpendicular to the ejection and retreating directions 202, 204. A plane 502 represents the surface of the printing plate 110 from which the fluid is expelled by the assembly 100. The plane 502 may be oriented perpendicular to the printing direction 404. The ejection and retreating directions 202, 204 may be oriented at acute angles 504 with respect to the plane 502.

Figure 6:
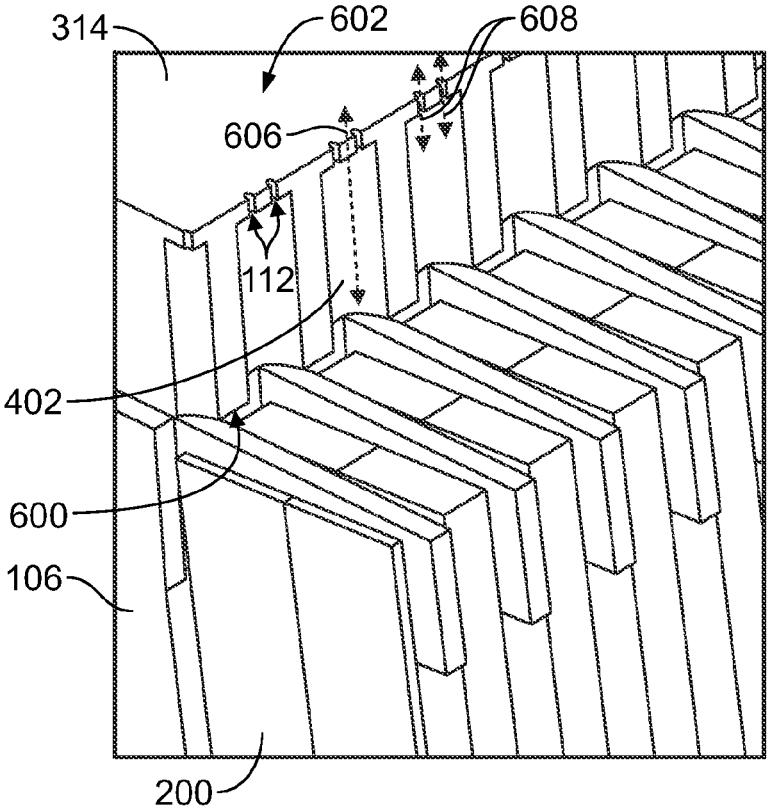
FIG. 6 is a cross-sectional view of a portion of the assembly shown in FIG. 1.

FIG. 6 is a cross-sectional view of a portion of the assembly 100 shown in FIG. 1. The cross-sectional view of FIG. 6 shows the relative positions of some of the pistons 200, a portion of the carrier body 106, and a portion of the chamber or orifice plate 314. As shown in FIG. 6, the openings 402 extend partially through the chamber or orifice plate 314 from a piston side 600 to an opposite exposed side 602. The exposed side 602 represents the side of the assembly 100 that is exposed to the object on which the fluid is printed from the assembly 100. The piston side 600 represents the internal side of the plate 314 that faces the pistons 200. The sides 600, 602 may be parallel to each other. Alternatively, the sides 600, 602 may be non-parallel to each other.

In the illustrated embodiment, the openings 402 extend into the body of the plate 314 from the piston side 600 toward, but not all the way to, the opposite exposed side 602. For example, the openings 402 may extend into the plate 314 to a distance of about 90% (or another percentage or fraction) of the entire thickness of the plate 314 that is measured from the piston side 600 to the exposed side 602. The orifices 112 extend through the body of the plate 314 from the openings 402 to the exposed side 602. For example, the orifices 112 may be fluidly coupled with and extend the remaining distance through the thickness of the body of the plate 314 from the openings 402. In the illustrated example, two orifices 112 are coupled with each of the openings 402. Conversely, a single orifice 112 or more than three orifices 112 may extend from one or more (or all) of the openings 402. As described above, when the pistons 200 are actuated in the ejection direction 202 (shown in FIG. 2), the fluid to be printed is pushed or otherwise forced by the pistons 200 into the openings 402 and out of the assembly 100 via the orifices 112.

The openings 402 are elongated along and extend along center axes 604 and the orifices 112 are elongated along and extend along center axes 606. The center axes 604, 606 may be parallel to each other, or substantially parallel to each other (e.g., when taking into account manufacturing tolerances that may prevent the axes from being exactly parallel). Additionally, the axes 604 and/or the axes 606 may be parallel or substantially parallel to the printing direction 404. For example, because the fluid is ejected from the assembly 100 out of the orifices 112, the direction of alignment of the orifices 112 (e.g., the axes 606) may be the same as the printing direction 404 for the fluid that is ejected from each orifice 112. As a result, the axes 604 and/or the axes 606 of the openings 402 and the orifices 112 may be transversely oriented (e.g., not parallel or perpendicular) to the ejection and/or retreating directions 202, 204 (shown in FIG. 2).

The orifices 112 have a much smaller diameter than the openings 402 in the illustrated embodiment. The length of the orifices 112 (e.g., the dimension of the orifices 112 extending along the axes 606 from the openings 402 to the exposed side 602) may be smaller or much smaller than the length of the openings 402 (e.g., the dimension of the openings 402 along the axes 604 from the piston side 600 to the orifices 112). The orifices 112 may be significantly shorter than the openings 402 to reduce or eliminate the possibility of contaminants in the fluid from clogging the orifices 112.

Figure 7:
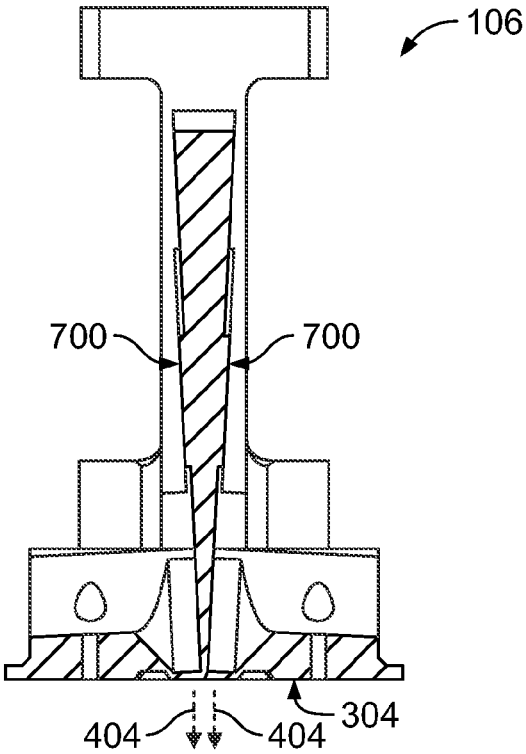
FIG. 7 is a cross-sectional view of a carrier body shown in FIG. 1 along line 7-7 in FIG. 3.

FIG. 7 is a cross-sectional view of the carrier body 106 along line 7-7 in FIG. 3. The carrier body 106 includes opposite supporting surfaces 700 that face in opposite directions. The supporting surfaces 700 represent interfaces along which the pistons 200 move during printing of the fluid with the assembly 100 shown in FIG. 1. For example, the pistons 200 may be disposed on the surfaces 700 or on other bodies that are between the pistons 200 and the surfaces 700. The pistons 200 may move in the ejection and retreating direction 202, 204 along the surfaces 700. For example, the surfaces 700 may be angled with respect to the printing direction 404 of the assembly 100. The surfaces 700 may be transversely oriented with respect to the printing direction 404 such that the surfaces 700 are not parallel or perpendicular to the printing direction 404. The surfaces 700 may be oriented at the angle 500 (shown in FIG. 5) with respect to the printing direction 404 such that the pistons 200 move parallel to the surfaces 700 when the pistons 200 are actuated in the ejection and/or retreating directions 202, 204.

As shown in FIG. 7, the angled orientation of the surfaces 700 results in the surfaces 700 extending toward each other at or near the ejection side 304 of the carrier body 106. For example, the surfaces 700 may be oriented closer together at or near the ejection side 304 of the carrier body 106 than in other locations of the carrier body 106, such as the opposite side or end of the carrier body 106.

Figure 8:
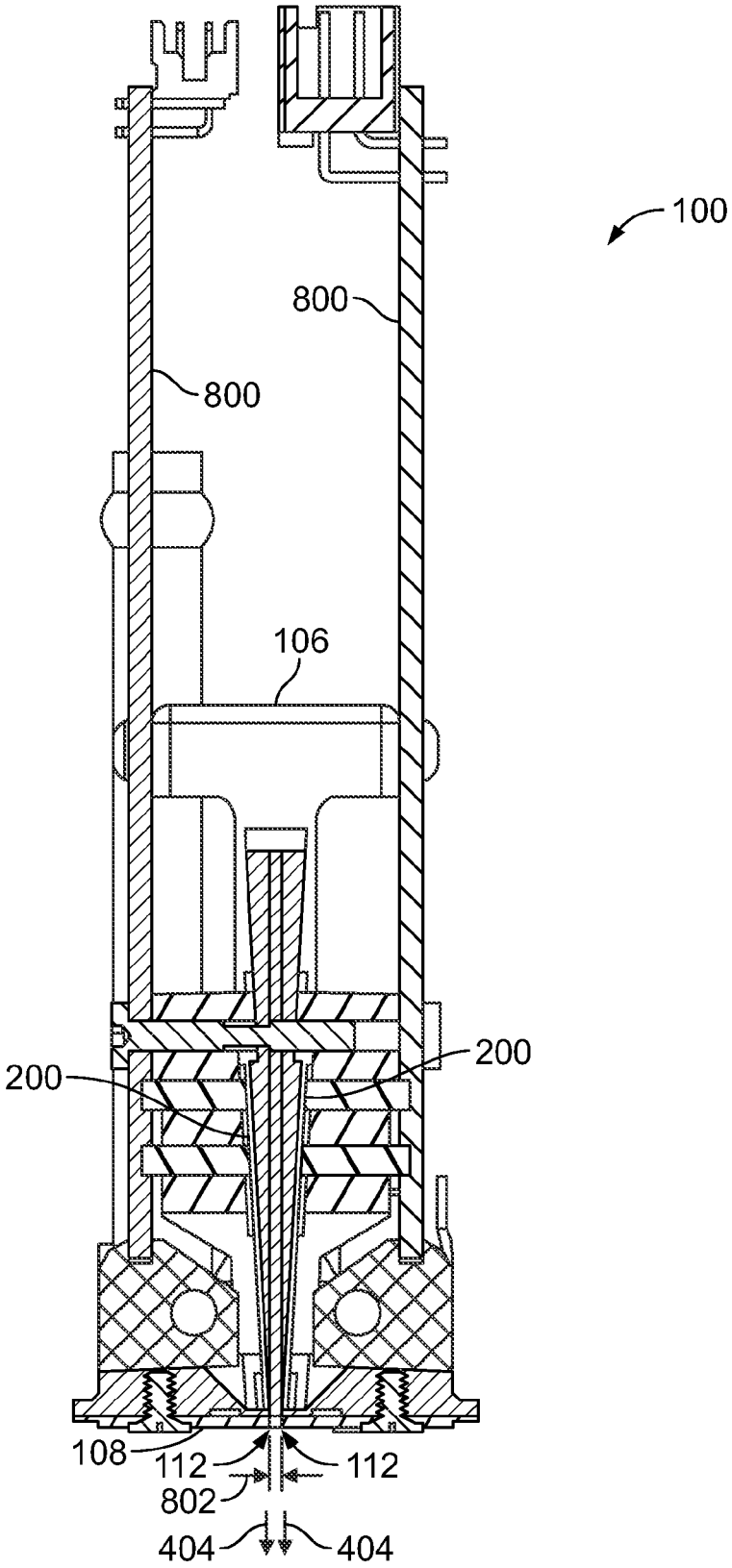
FIG. 8 is a cross-sectional view of the assembly shown in FIG. 1 along line 8-8 in FIG. 1.

With continued reference to FIG. 7, FIG. 8 is a cross-sectional view of the assembly 100 along line 8-8 shown in FIG. 1. In the illustrated embodiment, the carrier body 106 is coupled with opposing boards 800, such as circuit boards or other bodies. These boards 800 may include hardware circuitry that controls the supply of electric current to the pistons 200 to actuate the pistons 200. In one embodiment, the angled orientation of the surfaces 700 of the carrier body 106 allow for the pistons 200 to be oriented along the surfaces 700 and to be actuated along the ejection and retreating directions 202, 204 (shown in FIG. 2) that are transversely oriented with respect to each other.

The pistons 200 shown in FIG. 8 can represent one pair of many pairs of pistons 200 in the assembly 100. The pistons 200 in a pair may be disposed on the surfaces 700 on opposite sides of the carrier body 106. As shown in FIGS. 1 and 8, the orifices 112 also may be arranged in similar pairs.

Orienting the pistons 200 in an angled arrangement such as that shown in FIG. 8 can allow for the orifices 112 of the assembly 100 to be located closer together than would otherwise be achievable with the pistons 200 in another arrangement. The orifices 112 are spaced apart from each other by a lateral separation distance 802. This distance 802 can be measured in a direction that is perpendicular to the printing direction 404 and/or that is parallel to the front printing end 108 of the assembly 100.

The pistons 200 may need to be a minimum size (e.g., thickness) in order to be actuated and move in the ejection direction 202 to cause the assembly 100 to print the fluid onto objects. Because of this minimum size, the pistons 200 may be limited on how closely the pistons 200 can be to each other if the pistons 200 are in another orientation. For example, if the ejection and retreating directions 202, 204 of each piston 200 were oriented parallel to each other (e.g., with the pistons 200 being oriented parallel to each other), then the minimum size of the pistons 200 may result in the separation distance 802 being larger than if the pistons 200 were oriented as shown in FIG. 8. The pistons 200 may need to be a minimum thickness so that the electric energy that is supplied to the pistons 200 to actuate the pistons 200 sufficiently far in the ejection direction 202 to cause ejection of fluid from the orifices 112. Thinner pistons 200 may result in the fluid not being ejected from the orifices 112. While increased electric energy (e.g., voltage) may be applied to thinner pistons 200, the electric energy may be too large and may cause interference in other pistons 200. For example, with relatively thin pistons 200 that are close to each other, the increased voltage applied to actuate one piston 200 may inadvertently induce cross-talk in another piston 200 and cause this other piston 200 to at least partially actuate, even if the other piston 200 is not to be actuated at that time.

Additionally or alternatively, the bulk of the bodies of the pistons 200 may need to be spaced at least a minimum separation distance apart to prevent or significantly reduce this cross-talk between the pistons 200. This minimum separation distance then limits how small the separation distance 802 between the orifices 112 can be from each other for a pair of pistons 200. In one aspect, the orifices 112 may need to be at least a minimum lateral separation distance from each other when the pistons 200 in a pair are parallel to each other and/or the ejection directions 202 of these pistons 200 are parallel to each other.

Orienting the pistons 200 in the pair of pistons 200 so that the pistons 200 and the ejection directions 202 are transversely oriented with respect to each other, however, can reduce the separation distance 802 between the orifices 112 of the pistons 200 in the pair below this minimum separation distance. For example, angling the pistons 200 as shown in FIG. 8 can allow for the pistons 200 to be sufficiently far away from each other that the pistons 200 can be sufficiently thick that a relatively small amount of electric energy (e.g., voltage) is used to actuate the pistons 200 and/or that the electric energy applied to one piston 200 does not induce cross-talk (and actuation) of another piston 200. The angled orientation of the pistons 200 thereby allows the orifices 112 to be closer together. For example, the separation distance 802 between the orifices 112 can be reduced by orienting the pistons 200 in the pairs at the angles 500 (shown in FIG. 5) with respect to the printing directions 404 relative to the pistons 200 in the pairs being oriented parallel to each other.

Reducing the size of the lateral separation distance 802 can significantly increase the printing resolution of the assembly 100. For example, changing the orientation of the pistons 200 from a parallel arrangement (where the pistons 200 in each of the pairs of pistons 200 are parallel to each other) to the angled arrangement shown in FIG. 8 can double the printing resolution of the assembly 100, such as by halving the separation distance 802. As one example, the dot-per-inch resolution ("dpi") of the assembly 100 may be 64 dpi if the pistons 200 in the pairs are oriented parallel to each other, but can be increased to at least 120 or 128 dpi when the pistons 200 are angled with respect to each other.

Figure 9:
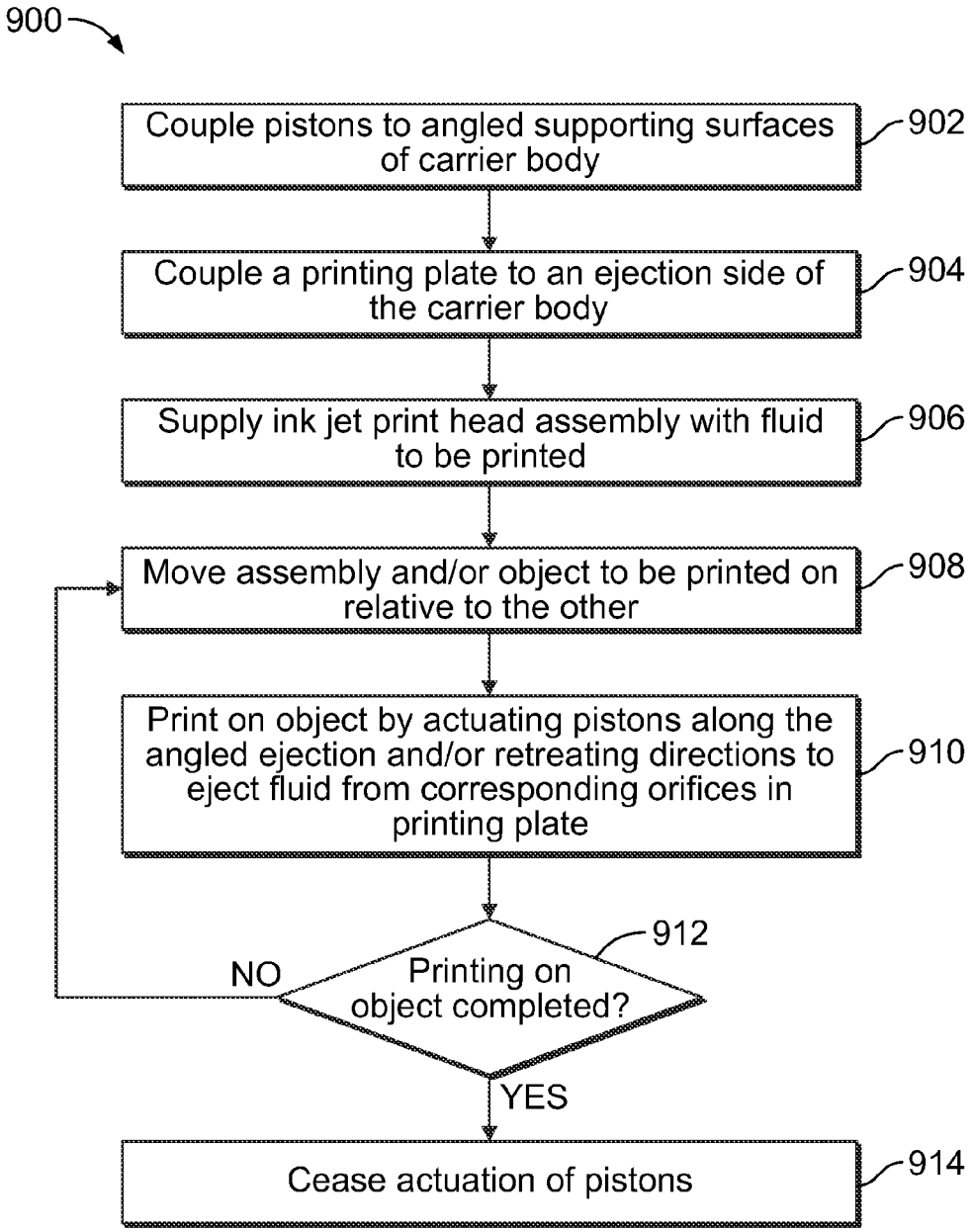
FIG. 9 is a flowchart of a method for ink jet printing according to one embodiment of the inventive subject matter described herein.

FIG. 9 is a flowchart of a method 900 for ink jet printing according to one embodiment of the inventive subject matter described herein. The method 900 may be used to manufacture and/or use one or more embodiments of the ink jet printing head assembly 100 shown and described herein.

At 902, the pistons 200 are coupled to angled supporting surfaces 700 of the carrier body 106. The pistons 200 may be rigidly coupled to the surfaces 700 in one or more locations such that the pistons 200 do not displace (e.g., slide) along the surfaces 700 when actuated, but that change size (e.g., length) relative to the surfaces 700 when actuated. Optionally, the pistons 200 may be displaced (e.g., slide) along the surfaces 700 when actuated. Alternatively, the pistons 200 may be coupled to one or more intervening layers or bodies disposed between the pistons 200 and the surfaces 700.

At 904, the printing plate 110 is coupled to the ejection side 304 of the carrier body 106 to form the assembly 100. At 906, fluid that is to be printed on one or more objects is supplied to the assembly 100. For example, the assembly 100 may be at least partially fed and/or filled with an ink or other liquid that extends into the chambers 316 of the assembly 100 for being printed on the objects.

At 908, one or more of the assembly 100 and/or the object (s) to be printed upon by the assembly 100 move relative to one another. For example, the assembly 100 may be placed in relatively close proximity to the object(s) and the object(s) may move along a conveyor or other mechanism relative to the assembly 100. Conversely or additionally, the assembly 100 may move relative to the object(s).

At 910, the object that is near the assembly 100 is printed upon with the fluid in the assembly 100. As described above, the assembly 100 ejects the fluid from the assembly 100 and onto the object by actuating the pistons 200 along transverse (e.g., acutely angled) directions with respect to the direction in which the fluid is ejected from the assembly 100. After moving in the ejection directions 202, the pistons 200 may retreat along the opposite retreating directions 204 in order to allow for additional fluid to enter into the chambers 316.

At 912, a determination is made as to whether the image, text, and/or other indicia (e.g., bar code, picture, words, or the like) being printed onto the object is complete. If the printing of the image, text, and/or indicia is complete, then flow of the method 900 may proceed to 914, where printing on the object is completed. Alternatively, flow of the method 900 may return to 908 so that additional printing of the fluid on the object may be performed.

In one embodiment, an ink jet print head assembly includes a carrier body, plural pistons, and a printing plate. The carrier body has an ejection side configured to face an object to be printed upon. The pistons are coupled with the carrier body. The printing plate is coupled with the ejection side of the carrier body and includes a diaphragm plate. The printing plate is configured to hold a fluid to be printed on the object on a side of the diaphragm plate that is opposite of the pistons. The printing plate includes orifices through which the fluid is ejected from the printing plate and onto the object being printed upon. The pistons are configured to actuate in ejection directions in order to engage the diaphragm plate and cause the fluid to be ejected from the orifices of the printing plate along printing directions. The ejection directions in which the pistons are actuated are transversely oriented with respect to the printing directions in which the fluid is ejected from the printing plate.

In one aspect, the ejection directions in which the pistons are actuated are oriented at acute angles with respect to the printing directions in which the fluid is ejected from the printing plate.

In one aspect, the ejection directions in which the pistons are actuated are oriented at non-parallel and non-perpendicular angles with respect to the printing directions in which the fluid is ejected from the printing plate.

In one aspect, the pistons include or are formed from piezoelectric materials and are actuated along the ejection directions by applying electric energy to the pistons.

In one aspect, the pistons are actuated along the ejection directions when the pistons increase in length along the ejection directions.

In one aspect, the pistons are elongated along the ejection directions and the pistons are actuated along the ejection directions when the electric energy is applied as at least one of a voltage or an electric field oriented along the ejection directions.

In one aspect, the carrier body includes angled supporting surfaces to which the pistons are connected. The supporting surfaces can be oriented parallel to the ejection directions of the pistons.

In one aspect, the pistons are arranged in one or more pairs of pistons with first ends of the pistons in the pairs that engage the diaphragm plate to eject the fluid from the printing plate and onto the object via the orifices being disposed closer together than opposite second ends of the pistons in the pairs.

In one embodiment, an ink jet print head assembly includes a carrier body and plural pistons. The carrier body has an ejection side configured to face an object to be printed upon. The pistons are coupled with the carrier body. The pistons are configured to actuate in ejection directions in order to engage a diaphragm plate in a printing plate connected with the ejection side of the carrier body and cause fluid in the printing plate to be ejected from the orifices of the printing plate along printing directions. The ejection directions in which the pistons are actuated are transversely oriented with respect to the printing directions in which the fluid is ejected from the printing plate.

In one aspect, the ejection directions in which the pistons are actuated are oriented at acute angles with respect to the printing directions in which the fluid is ejected from the printing plate.

In one aspect, the ejection directions in which the pistons are actuated are oriented at non-parallel and non-perpendicular angles with respect to the printing directions in which the fluid is ejected from the printing plate.

In one aspect, the pistons include or are formed from piezoelectric materials and are actuated along the ejection directions by applying electric energy to the pistons.

In one aspect, the pistons are actuated along the ejection directions when the pistons increase in length along the ejection directions.

In one aspect, the pistons are elongated along the ejection directions and the pistons are actuated along the ejection directions when the electric energy is applied as at least one of a voltage or an electric field oriented along the ejection directions.

In one aspect, the carrier body includes angled supporting surfaces to which the pistons are connected. The supporting surfaces are oriented parallel to the ejection directions of the pistons.

In one aspect, first ends of the pistons that engage the diaphragm plate to eject the fluid from the printing plate and onto the object via the orifices are disposed closer together than opposite second ends of the pistons.

In one embodiment, an ink jet print head assembly includes a printing plate, a carrier body, and plural pistons. The printing plate includes a printing end configured to face an object to be printed upon by a fluid. The printing plate also includes separate chambers in which the fluid is disposed prior to printing on the object and orifices through which the fluid is ejected from the printing plate and onto the object. The carrier body is configured to be coupled with the printing plate. The pistons are configured to be coupled with the carrier body and to be actuated to strike the chambers in the printing plate and cause the fluid in the chambers to be expelled from the printing plate via the orifices. The pistons are configured to be strike the chambers when the pistons are actuated along ejection directions that are oriented at non-parallel and non-perpendicular angles with respect to the printing end of the printing plate.

In one aspect, the pistons include or are formed from piezoelectric materials and are actuated along the ejection directions when at least one of an electric field or a voltage is applied to the pistons in directions that are along or parallel to the ejection directions.

In one aspect, the fluid is expelled from the printing plate toward the object along printing directions and the ejection directions of the pistons are oriented at acute angles with respect to the printing directions.

In one aspect, the carrier body includes angled supporting surfaces to which the pistons are connected. The supporting surfaces are oriented parallel to the ejection directions of the pistons.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure. For example, the recitation of a "mechanism for," "module for," "device for," "unit for," "component for," "element for," "member for," "apparatus for," "machine for," or "system for" is not to be interpreted as invoking 35 U.S.C. §112, sixth paragraph and any claim that recites one or more of these terms is not to be interpreted as a means-plus-function claim.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

The invention claimed is:

1. An ink jet print head assembly comprising:

a carrier body having an ejection side configured to face an object to be printed upon and angled supporting surfaces on opposite sides of the carrier body, the supporting surfaces are oriented at acute angles with respect to the ejection side, the supporting surfaces extending from first ends of the carrier body to opposite second ends with the first ends of the supporting surfaces located closer to the ejection side than the second ends of the supporting surfaces and with the first ends of the supporting surfaces located closer together than the second ends of the supporting surfaces;

plural elongated pistons coupled with the carrier body along the supporting surfaces of the carrier body, the pistons extending from first ends to opposite second ends with the first ends of the pistons located closer to each other and closer to the ejection side of the carrier body than the second ends of the pistons; and a printing plate coupled with the ejection side of the carrier body, the printing plate including a diaphragm plate and configured to hold a fluid to be printed on the object on a side of the diaphragm plate that is opposite of the pistons, the printing plate including orifices through which the fluid is ejected from the printing plate and onto the object being printed upon, wherein the pistons are configured to actuate in ejection directions in order to engage the diaphragm plate and cause the fluid to be ejected from the orifices of the printing plate along printing directions, wherein the pistons are disposed on the opposite sides of the carrier body along the supporting surfaces of the carrier body such that the supporting surfaces extend along at least a majority of lengths of the pistons along the ejection directions, and wherein the ejection directions in which the pistons are actuated are transversely oriented at acute angles with respect to the printing directions in which the fluid is ejected from the printing plate.

2. The ink jet print head assembly of claim 1, wherein the ejection directions in which the pistons are actuated are oriented at acute angles with respect to each other.

3. The ink jet print head assembly of claim 1, wherein the ejection directions in which the pistons are actuated are oriented at non-parallel and non-perpendicular angles with respect to the printing directions in which the fluid is ejected from the printing plate.

4. The ink jet print head assembly of claim 1, wherein the pistons include or are formed from piezoelectric materials and are actuated along the ejection directions by applying electric energy to the pistons.

5. The ink jet print head assembly of claim 4, wherein the pistons are actuated along the ejection directions when the pistons increase in length along the ejection directions.

6. The ink jet print head assembly of claim 4, wherein the pistons are elongated along the ejection directions and the pistons are actuated along the ejection directions when the electric energy is applied as at least one of a voltage or an electric field oriented along the ejection directions.

7. The ink jet print head assembly of claim 1, wherein the pistons are connected to the supporting surfaces of the carrier body and the supporting surfaces are oriented parallel to the ejection directions of the pistons.

8. The ink jet print head assembly of claim 1, wherein the pistons are arranged in one or more pairs of pistons with the first ends of the pistons in the pairs engaging the diaphragm plate to eject the fluid from the printing plate and onto the object via the orifices.

9. The ink jet print head assembly of claim 1, wherein the pistons are configured to slide along the angled supporting surfaces of the carrier body in opposite directions that include the ejection directions.

10. The ink jet print head assembly of claim 1, wherein the first ends of the pistons engage the diaphragm plate and the carrier body includes a portion disposed between the first ends of the pistons.

11. An ink jet print head assembly comprising:

a carrier body having an ejection side configured to face an object to be printed upon and angled supporting surfaces on opposite sides of the carrier body, the supporting surfaces are oriented at acute angles with respect to the ejection side, the supporting surfaces extending from first ends to opposite second ends with the first ends of the supporting surfaces located closer to the ejection side than the second ends of the supporting surfaces and with the first ends of the supporting surfaces located closer together than the second ends of the supporting surfaces; and plural elongated pistons coupled with the carrier body along the supporting surfaces of the carrier body, the pistons extending from first ends to opposite second ends with the first ends of the pistons located closer to each other and closer to the ejection side of the carrier body than the second ends of the pistons, the pistons configured to actuate in ejection directions in order to engage a diaphragm plate in a printing plate that is connected with the ejection side of the carrier body and to cause fluid in the printing plate to be ejected from the orifices of the printing plate along printing directions, wherein the pistons are disposed on the opposite sides of the carrier body along the supporting surfaces of the carrier body such that the supporting surfaces extend along at least a majority of lengths of the pistons along the ejection directions, wherein the ejection directions in which the pistons are actuated are transversely oriented at acute angles with respect to the printing directions in which the fluid is ejected from the printing plate.

12. The ink jet print head assembly of claim 11, wherein the ejection directions in which the pistons are actuated are oriented at acute angles with respect to each other.

13. The ink jet print head assembly of claim 11, wherein the ejection directions in which the pistons are actuated are oriented at non-parallel and non-perpendicular angles with respect to the printing directions in which the fluid is ejected from the printing plate.

14. The ink jet print head assembly of claim 11, wherein the pistons include or are formed from piezoelectric materials and are actuated along the ejection directions by applying electric energy to the pistons.

15. The ink jet print head assembly of claim 14, wherein the pistons are actuated along the ejection directions when the pistons increase in length along the ejection directions.

16. The ink jet print head assembly of claim 14, wherein the pistons are elongated along the ejection directions and the pistons are actuated along the ejection directions when the electric energy is applied as at least one of a voltage or an electric field oriented along the ejection directions.

17. The ink jet print head assembly of claim 11, wherein the pistons are connected to the supporting surfaces of the carrier body and the supporting surfaces are oriented parallel to the ejection directions of the pistons.

18. The ink jet print head assembly of claim 11, wherein the first ends of the pistons engage the diaphragm plate to eject the fluid from the printing plate and onto the object via the orifice.

19. An ink jet print head assembly comprising:

a printing plate comprising a printing end configured to face an object to be printed upon by a fluid, the printing plate including separate chambers in which the fluid is disposed prior to printing on the object and orifices through which the fluid is ejected from the printing plate and onto the object;

a carrier body configured to be coupled with the printing plate and including angled supporting surfaces on opposite sides of the carrier body, the supporting surfaces are oriented at acute angles with respect to the ejection side, the supporting surfaces extending from first ends to opposite second ends with the first ends of the supporting surfaces located closer to the ejection side than the second ends of the supporting surfaces and with the first ends of the supporting surfaces located closer together than the second ends of the supporting surfaces; and plural elongated pistons configured to be coupled with the carrier body along the supporting surfaces of the carrier body, the pistons extending from first ends to opposite second ends with the first ends of the pistons located closer to each other and closer to the ejection side of the carrier body than the second ends of the pistons, the pistons configured to be actuated to strike the chambers in the printing plate and cause the fluid in the chambers to be expelled from the printing plate via the orifices, wherein the pistons are configured to be strike the chambers when the pistons are actuated along ejection directions that are oriented at non-parallel and non-perpendicular angles with respect to the printing end of the printing plat, wherein the pistons are disposed on the opposite sides of the carrier body along the supporting surfaces of the carrier body such that the supporting surfaces extend along at least a majority of lengths of the pistons along the ejection directions.

20. The ink jet print head assembly of claim 19, wherein the pistons include or are formed from piezoelectric materials and are actuated along the ejection directions when at least one of an electric field or a voltage is applied to the pistons in directions that are along or parallel to the ejection directions.

21. The ink jet print head assembly of claim 19, wherein the fluid is expelled from the printing plate toward the object along printing directions and the ejection directions of the pistons are oriented at acute angles with respect to the printing directions.

22. The ink jet print head assembly of claim 19, wherein the pistons are connected to the supporting surfaces of the carrier body and the supporting surfaces are oriented parallel to the ejection directions of the pistons.

23. The ink jet print head assembly of claim 19, wherein the pistons are configured to slide along the angled supporting surfaces of the carrier body in opposite directions that include the ejection directions.

* * * * *